United States Patent [19]

Takeuchi et al.

[11] Patent Number: 4,641,760

[45] Date of Patent: Feb. 10, 1987

[54] INFLATABLE BAGS

[75] Inventors: Seiji Takeuchi, Burlington; Byron H. Anger, Hamilton, both of Canada

[73] Assignees: Don Fell Limited; Donfab Investments, Inc., both of Hamilton, Canada

[21] Appl. No.: 799,324

[22] Filed: Nov. 18, 1985

[30] Foreign Application Priority Data

Oct. 8, 1985 [CA] Canada ..... 492494

[51] Int. Cl.[4] ..... B65D 30/28

[52] U.S. Cl. ..... 220/1 B; 206/223; 206/436; 206/522; 220/68; 222/319

[58] Field of Search ..... 206/223, 522, 436; 220/85 B, 85 R, 68, 1 B; 222/319, 386.5; 383/2–4, 32, 37, 108, 127, 902, 907

[56] References Cited

U.S. PATENT DOCUMENTS

| | | | |
|---|---|---|---|
| 1,602,354 | 10/1926 | Fowler . | |
| 2,105,160 | 1/1938 | Piquerez . | |
| 2,730,150 | 1/1956 | Wunderwald | 383/907 |
| 2,798,639 | 7/1957 | Urban . | |
| 2,956,839 | 10/1960 | Hermanns | 222/386.5 |
| 3,810,654 | 5/1974 | DeBano, Jr. et al. | 383/3 |

FOREIGN PATENT DOCUMENTS

| | | | |
|---|---|---|---|
| 0821195 | 9/1959 | United Kingdom | 383/3 |
| 0958500 | 5/1964 | United Kingdom | 206/522 |
| 2110192 | 6/1983 | United Kingdom | 222/386.5 |

*Primary Examiner*—William Price
*Assistant Examiner*—Jimmy G. Foster

[57] ABSTRACT

A false bottom in a cylindrical storage tank is formed from an array of two or more concentric series of inflated bags that individually have the shape of either an isosceles triangle or a truncated isosceles triangle.

6 Claims, 7 Drawing Figures

INFLATABLE BAGS

BACKGROUND OF THE INVENTION

The invention relates to inflatable bags for use in forming a false bottom in a storage tank.

Cylindrical storage tanks of the type used for the bulk storage of liquids, e.g. fuels, oil and chemicals, have traditionally been designed with the main drain outlet located in the tank wall a few feet above the tank floor. This ensures that in normal use the tank is never fully emptied, although there will also be a sump drain whereby the remaining liquid and any accumulated sludge can be removed. For many purposes, i.e. when storing certain liquids, this arrangement is preferred. However, at other times, e.g. for other liquids, it is preferred to be able to extract virtually all the stored liquid through the main outlet, i.e. so that no liquid remains when the tank has been emptied to the level of this main outlet, an advantage of this method of operation being a reduction in the inventory of stored liquid on hand.

The purpose of the present invention is to provide means for forming a removable false bottom in such a tank, thus providing it with the versatility to operate in either of the above-described modes, i.e. in the manner in which it was built with the floor a few feet below the main outlet level, or with an effective floor (false bottom) substantially at such level. A basic requirement of the invention is to provide means for forming such a false bottom in a manner that enables it to be relatively easily set up or dismantled without involving major engineering work.

Storage tanks are generally large structures, e.g. 120 feet in diameter, and of substantial height. They often have floating roofs that slide up and down as the volume of liquid in the tank varies, and they are thus effectively closed. Any attempt to use a metal false bottom would involve a massive structure and, when there is a roof, its removal before the bottom could be installed. Access to the inside of such a tank is generally provided by a manhole, usually located in the side at ground level, and hence, a further important factor is that the means for forming the false bottom should be capable of being taken into the tank or removed therefrom through such a manhole.

A solution to these problems is to use liquid tight, inflatable bags to form the false bottom. For example, the false bottom can be constructed of a number of inflatable bags that can be individually folded when deflated (in order to be able to pass through the manhole), but, once in place on the floor of the tank, can be inflated with a suitable liquid, e.g. water or brine, heavier than the liquid to be stored, e.g. oil. It is possible to arrange the shapes of the bags so that they occupy the entire surface of the tank floor, while extending up to approximately the level of the main outlet, so that the desired false bottom effect can be achieved. Alternatively, if the floor of the tank is cluttered with filling pipes, supports for such pipes, sump equipment and/or guides or supports for the floating roof, the number and arrangement of the bags can be varied to accommodate this equipment. If the bags are of the correct shape and are packed closely together, once they have been inflated their adjacent sides will press firmly against each other and against the cylindrical wall of the tank, thus making a virtually liquid tight bottom. There may be some minor seepage of the stored liquid between adjacent bags or between the bags and the tank wall, but this will be no large amount and will represent no serious disadvantage.

It is of course important that the bags themselves be reliably liquid tight in order to avoid the water or brine with which they are filled contaminating the stored liquid. Brine will be preferred when the stored liquid is oil, since, if there should be a leaky bag, the brine will be more immiscible with the oil than plain water would be.

It is also important that the material of the bags be chemically inert to the stored liquid. A convenient material to use will be a coated fabric, e.g. a metalised fabric, or one coated with a PVC alloy that withstands attack by oil. The material of the bags may require modification for different stored liquids in order to retain this necessary chemically inert relationship.

SUMMARY OF THE INVENTION

With these requirements in mind, the invention, in its broad scope, provides an inflatable bag of tough, flexible, liquid tight material, said bag having a shape defined by (a) a pair of similar top and bottom panels each having tapering side edges, (b) a pair of rectangular side panels similar to each other and interconnecting respective ones of said side edges, (c) a rectangular outer panel interconnecting respective outer end edges of the top, bottom and side panels, said outer end edges being located at the outwardly tapered ends of said side panels, and (d) means interconnecting inner end edges of the top, bottom and side panels at the inwardly tapered ends of said side panels.

In a first form, the top and bottom panels have the shape of an isosceles triangle so that their side edges taper to a point and the inner end edges of the side panels are connected to each other. In other words, the bag takes the form of a pie segment. When these bags are arranged in a tank, they become a closed circular inner series arranged with their tips together at the central vertical axis of the tank.

In a second form of bag, the top and bottom panels have the shape of a truncated isosceles triangle, the inner end edges of the side panels being joined to each other and to the inner end edges of the top and bottom panels by a rectangular inner panel. Bags of this second shape are formed into at least one annular series surrounding the inner series, with their inner panels adjacent the outer panels of the inner series, or, in the case of second and subsequent annular series, with their inner panels adjacent the outer panels of an inner one of the annular series. The outer panels of the outermost annular series will lie adjacent the cylindrical wall of the tank.

As well as relating to the bags themselves and to such an array of a plurality of concentric series of bags in a tank, the invention consists of a kit of bags for use in the manner described.

DETAILED DESCRIPTION OF THE PREFERRED EMBODIMENT

Figure 1A:
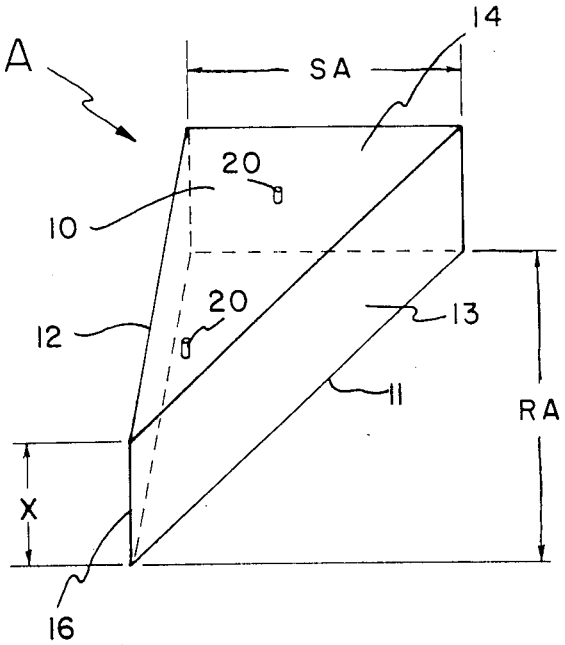
Figures 1A, 1B, 1C and 1D respectively show perspective views of four different shapes of bags constituting embodiments of the invention.
Figure 1B:
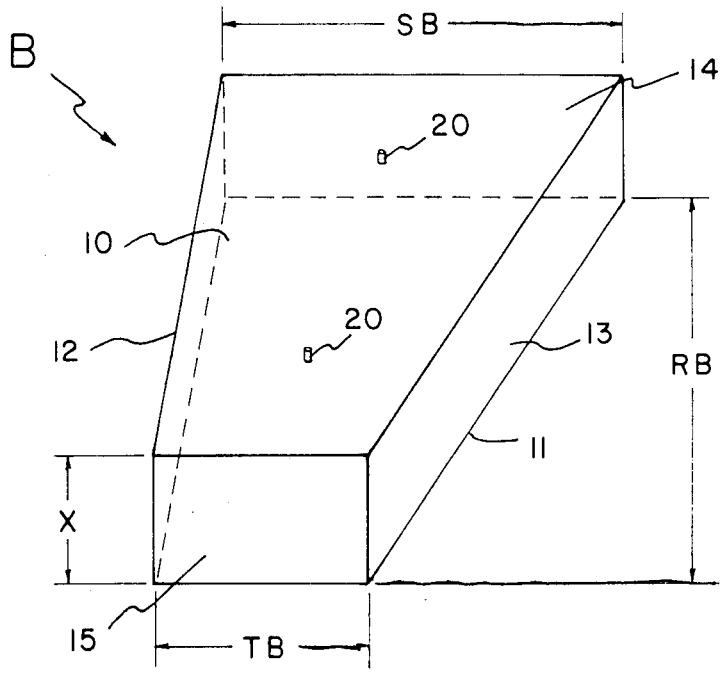
Figure 1C:
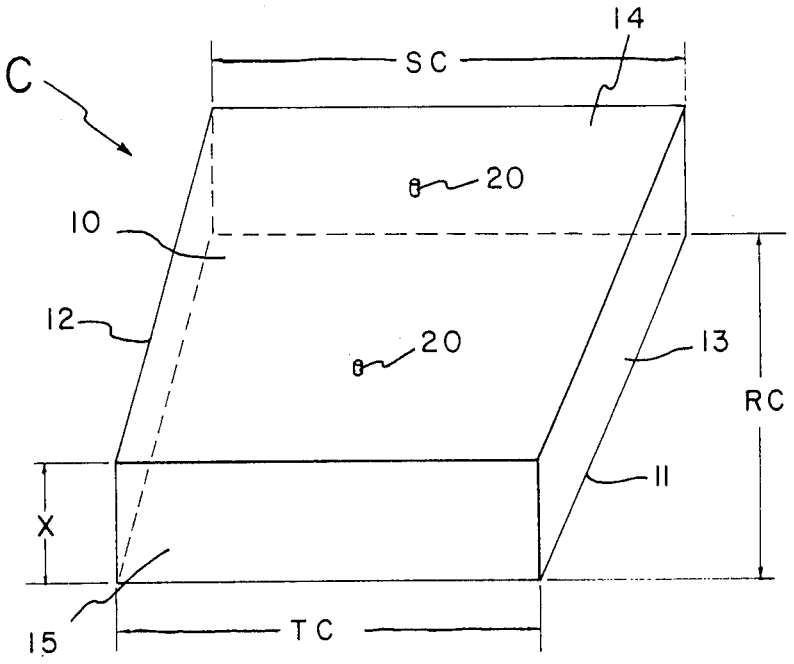
Figure 1D:
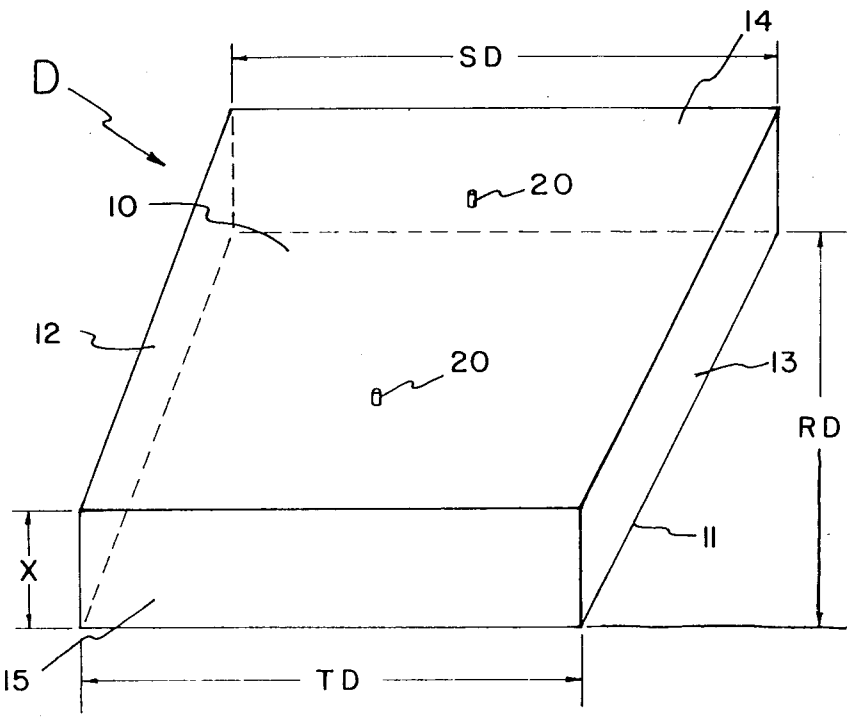

FIGS. 1A–1D respectively show four bags A, B, C and D. These bags are made of a tough, flexible, liquid tight material, e.g. a metalised or otherwise coated fabric, and can thus adopt either a deflated, foldable condition or an expanded, inflated condition as shown in the drawings. It should be explained that the illustrations and descriptions of the bag shapes are idealised. The shapes shown in FIGS. 1A–1D indicate how the various flat panels of material that make up the bags are seamed. When deflated the bags will be shapeless, and when inflated with a liquid their panels will naturally bulge under the weight of the liquid.

Each of the bags has a height X; a radius dimension RA, RB, RC, RD, respectively; an outer circumferential dimensidn SA, SB, SC, SD, respectively; and an inner circumferential dimension TB, TC, TD, the bag A having an inner circumferential dimension of zero. These shapes are formed by top and bottom panels 10 and 11; tapering side panels 12 and 13; outer panels 14; and inner panels 15. In the case of the bag A, the inner panel is replaced by an edge 16 where the side panels 12 and 13 intersect.

Figure 2B:
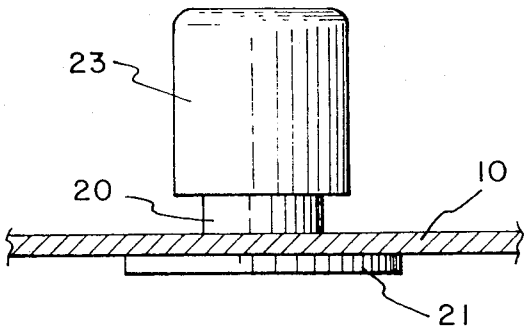
FIG. 2B is the same as FIG. 2A with the addition of a cap.
Figure 2A:
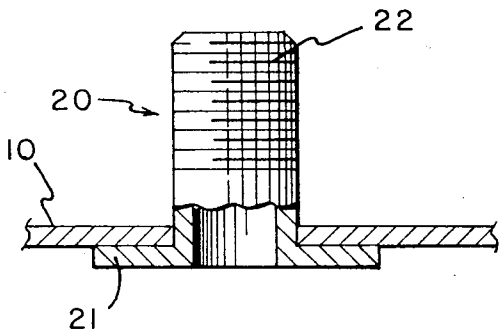
FIG. 2A is an enlarged fragment of a vent pipe employed in such bags.

Every bag is provided on its top panel 10 with a pair of pipes 20 (FIGS. 2A and 2B) for filling and venting. Each pipe 20 has a flange 21 bonded to the material of the panel 10, and a cylindrical portion with threads 22. A bag can be filled with liquid by engaging a hose (not shown) with the threads 22. After filling, each pipe can be closed off by means of a cap 23 which likewise engages the threads.

Figure 3:
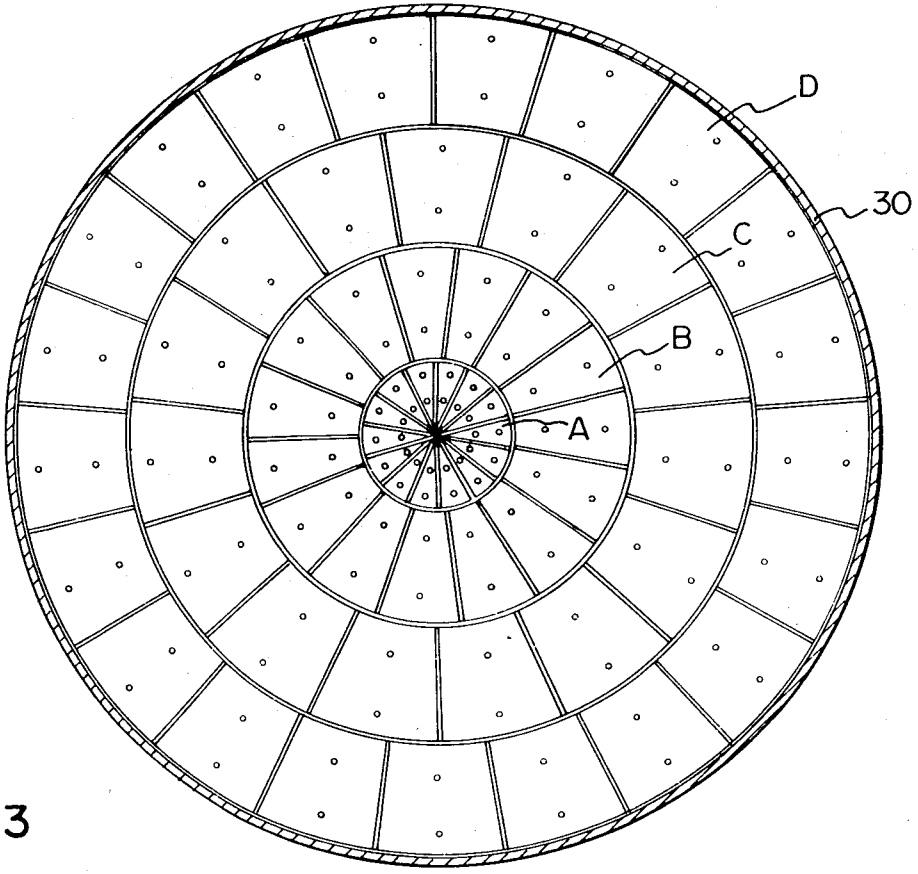
FIG. 3 is a schematic plan demonstrating the use of these bags in forming a false bottom.

FIG. 3 shows how the bags are arranged in a cylindrical tank 30. An inner circular series of bags A is arranged with their tips together at the central vertical axis of the tank. This inner series is surrounded by a first annulus of bags B, which is in turn surrounded by another annulus of bags C and finally an outer annulus of bags D. Depending on the diameter of the tank 30, the array of bags may consist of more or fewer annuli. Once in place on the floor of the tank, the bags will be filled with liquid, e.g. a brine solution, and capped, so that adjacent bags will firmly abut against each other to provide an effective, inflated false bottom for the tank. When thus packed together and inflated, the bag shapes will be approximately as shown in FIG. 3, although the boundaries between the coaxial series as seen in plan view may be closer to flat-sided polygons than to circles. However, the outer panels of the outermost annular series, i.e. bags D can be expected to be bowed outwardly sufficiently to engage tightly the cylindrical tank wall. When this array is to be removed, the bags are emptied so that each bag can be folded up and removed from the tank through a confined space, e.g. a man hole.

While the invention is in no sense limited to specific numbers or dimensions of bags, those that are currently proposed for the illustrated system are approximately:

Number of bags

Inner series of bags A=14
Next two annuli, i.e. bags B and C=15 each
Outer annulus=21

Dimensions in feet

X=3
RA=9
RB, RC and RD=17
SA=4
SB=11
SC and SD=18
TB=3.75
TC=11
TD=13
Diameter of the tank 30=120

We claim:

1. In combination with a storage tank having a vertically extending cylindrical wall defining a central vertical axis, an array of inflated bags of tough, flexible, liquid tight material arranged to form a false bottom in such tank;

(a) said array comprising an inner series of said bags surrounded by at least one annular series of said bags;

(b) each bag of the inner series having a shape defined by (i) a pair of similar top and bottom panels each having the shape of an isosceles triangle with tapering side edges, an end edge and a pointed tip, (ii) a pair of rectangular side panels similar to each other interconnecting respective ones of said side edges, (iii) a rectangular outer panel interconnecting respective ones of said end edges with each other and with outer end edges of the side panels, and (iv) means interconnecting inner end edges of the side panels with each other and with the tips of the top and bottom panels;

(c) said bags of the inner series being arranged with their tips at the central vertical axis of the tank in a closed circular arrangement;

(d) each bag of each annular series having a shape defined by (i) a pair of similar top and bottom panels each having the shape of a truncated isosceles triangle with tapering side edges and longer and shorter end edges, (ii) a pair of rectangular side panels similar to each other interconnecting respective ones of said side edges, (iii) a rectangular outer panel interconnecting respective ones of said longer end edges of the top and bottom panels with each other and with outer end edges of the side panels, and (iv) a rectangular inner panel interconnecting respective ones of said shorter end edges of the top and bottom panels with each other and with inner end edges of the side panels, (e) said bags of each annular series being arranged with their inner panels adjacent the outer panels of the bags of the inner series or of an inner one of said annular series in a closed annular arrangement coaxial with the inner series; and (f) the outer panels of the bags of the outermost annular series being adjacent said cylindrical tank wall.

2. The combination of claim 1, wherein there are three said annular series of bags arranged coaxially around the inner series and around each other, the angles of taper of the side edges of the top and bottom panels of the bags being progressively less from the innermost annular series to the outermost annular series.

3. A kit of inflatable bags of tough, flexible, liquid tight material for placing in a storage tank having a vertically extending cylindrical wall, to form a false bottom in such tank; said kit comprising (a) a number of said bags of a first shape each of which has (i) a pair of similar top and bottom panels each having the shape of an isosceles triangle with tapering side edges, an end edge and a pointed tip, (ii) a pair of rectangular side panels similar to each other interconnecting respective ones of said side edges, (iii) a rectangular outer panel interconnecting respective ones of said end edges with each other and with outer end edges of the side panels, and (iv) means interconnecting inner end edges of the side panels with each other and with the tips of the top and bottom panels; and (b) a number of said bags of a second shape each of which has (i) a pair of similar top and bottom panels each having the shape of a truncated isosceles triangle with tapering side edges and longer and shorter end edges, (ii) a pair of rectangular side panels similar to each other interconnecting respective ones of said side edges, (iii) a rectangular outer panel interconnecting respective ones of said longer end edges of the top and bottom panels with each other and with outer end edges of the side panels, and (iv) a rectangular inner panel interconnecting respective ones of said shorter end edges of the top and bottom panels with each other and with inner end edges of the side panels, (c) the number of bags of the first shape being sufficient to form a closed circular series of bags when inflated, and (d) the number of bags of the second shape being sufficient to form a closed annular series of bags when inflated closely surrounding the circular series of bags of the first shape.

4. A kit as claimed in claim 3, including (e) a number of bags of a third shape similar to the second shape but with the angle of taper of the side edges of the top and bottom panels less than in the second shape, (f) the number of bags of the third shape being sufficient to form a closed annular series of bags when inflated closely surrounding the annular series of bags of the second shape.

5. A kit as claimed in claim 4, including (g) a number of bags of a fourth shape similar to the third shape but with the angle of taper of the side edges of the top and bottom panels less than the third shape, (h) the number of bags of the fourth shape being sufficient to form a closed annular series of bags when inflated closely surrounding the annular series of bags of the third shape.

6. A kit as claimed in claim 5, wherein (i) the number and dimensions of bags of all four shapes are sufficient to form an array of bags when inflated fully occupying and forming a false bottom in a storage tank having a vertically extending cylindrical wall of standard diameter.

* * * * *